US005460103A

United States Patent [19]

Dunn et al.

[11] Patent Number: 5,460,103

[45] Date of Patent: Oct. 24, 1995

[54] METAL PALLET

[75] Inventors: Terrance M. K. Dunn, Calgary; Gary Pinder, Little Britain, both of Canada

[73] Assignee: Brunswick Metalpallets, Canada

[21] Appl. No.: 90,143

[22] PCT Filed: Feb. 17, 1992

[86] PCT No.: PCT/CA92/00062

§ 371 Date: Jul. 22, 1993

§ 102(e) Date: Jul. 22, 1993

[87] PCT Pub. No.: WO92/14654

PCT Pub. Date: Sep. 3, 1992

[30] Foreign Application Priority Data

Feb. 18, 1991 [CA] Canada ..... 2036526
Jun. 14, 1991 [CA] Canada ..... 2044695

[51] Int. Cl.[6] ..... B65D 19/00

[52] U.S. Cl. ..... 108/51.1

[58] Field of Search ..... 108/51.1, 56.1, 108/56.3

[56] References Cited

U.S. PATENT DOCUMENTS

| | | | |
|---|---|---|---|
| D. 291,935 | 9/1989 | Nordstrom . | |
| D. 301,079 | 5/1989 | DePew . | |
| 893,703 | 7/1908 | Butler | 108/51.1 X |
| 1,321,812 | 11/1919 | Drumm | 108/51.1 X |
| 2,152,086 | 3/1939 | Powell . | |
| 2,306,752 | 12/1942 | Riemenschneider et al. . | |
| 2,475,370 | 7/1949 | Bitney . | |
| 2,615,661 | 10/1952 | Cushman . | |
| 2,710,160 | 6/1955 | Bitney . | |
| 2,762,593 | 9/1956 | Weiss . | |
| 2,817,485 | 12/1957 | White et al. . | |
| 3,149,586 | 9/1964 | Kemp, Jr. et al. . | |
| 3,405,666 | 10/1968 | Miller . | |
| 3,561,374 | 2/1971 | Honderich . | |
| 3,581,680 | 6/1971 | Fleming | 108/51.1 |
| 3,602,157 | 8/1971 | Cohen . | |
| 3,616,766 | 11/1971 | Weiss | 108/51.1 |
| 3,756,167 | 9/1973 | Wilson . | |
| 3,762,344 | 10/1973 | Chez . | |
| 3,910,203 | 10/1975 | Hamkins et al. . | |

(List continued on next page.)

FOREIGN PATENT DOCUMENTS

| | | | |
|---|---|---|---|
| 97440 | 8/1987 | Australia . | |
| 683042 | 3/1964 | Canada . | |
| 897614 | 4/1972 | Canada . | |
| 1076496 | 4/1980 | Canada . | |
| 1159378 | 12/1983 | Canada . | |
| 59088 | 12/1986 | Canada . | |
| 60789 | 3/1987 | Canada . | |
| 064263 | 7/1989 | Canada . | |
| 68322 | 3/1991 | Canada . | |
| 68317 | 3/1991 | Canada . | |
| 68318 | 3/1991 | Canada . | |
| 68319 | 3/1991 | Canada . | |
| 68320 | 3/1991 | Canada . | |
| 68321 | 3/1991 | Canada . | |
| 1087089 | 2/1955 | France | 108/51.1 |
| 720735 | 8/1987 | Japan . | |
| 609769 | 10/1948 | United Kingdom | 108/51.1 |

OTHER PUBLICATIONS

Appendices A and B (photocopies of black and white photographs showing earlier pallet designs).

International Search Report and Annex PCT/CA92/00062 including WO86/00866, 13 Feb. 1986, Dash.

GROKO—The Lightweight Pallet That Stands Up to Forklift Abuse, Groko Pallets Catalog.

Banner Metals—Storage and Handling Information, Catalog.

AMPAL Pallets Inc.—"The Switch is On". Catalog.

*Primary Examiner*—Jose V. Chen

*Attorney, Agent, or Firm*—Leonard Bloom

[57] ABSTRACT

A metal pallet is designed to provide easy entry for pallet jacks and forklifts. Special end and side profiles surround the pallet top members and cross members to cover sharp edges and prevent separation of these members in the event of weld or other securement breakage.

11 Claims, 18 Drawing Sheets

U.S. PATENT DOCUMENTS 3,954,067 5/1976 Miles ..... 108/51.1 X
4,112,854 9/1978 Pitchford .
4,118,855 10/1978 Lequeux .
4,424,752 1/1984 Aberg .
4,485,794 12/1984 Umemura et al. ..... 108/51.1
4,697,529 10/1987 Kero et al. .
4,715,294 12/1987 Depew .

METAL PALLET

BACKGROUND OF THE INVENTION

This invention relates to improvements in pallets, particularly metal pallets.

The modern pallet, as we now know it, got its start with the invention of the forklift, which was used extensively during the World War II, when the military needed to move large amounts of materials over long distances. To do this loads were made up into unitized segments placed on pallets, which were then loaded and unloaded to and from trucks with forklifts. This was the start of modern day materials handling as we now know it.

Although pallets have been made from various types of materials from the start, wood has been the most common material used because of the low cost, availability of material, and the ease of building a variety of sizes. These advantages in the past outweighed the disadvantages, but in recent years wood pallets have become more costly as the lumber they are made from becomes less available and the proper disposal of these pallets becomes harder. Society today is more aware of the environment and is trying to find various techniques that are not only beneficial to the environment but are cost effective.

The materials handling industry is now demanding more from pallets; this industry wants economy, durability, uniformity, and increased safety. A wood pallet cannot satisfy these requirements.

Several manufacturers have introduced pallets made from plastic materials. These have found use in various applications but have a number of disadvantages in that the plastic materials can crack or chip and these pieces can fall off and jam conveyors or palletizers. Most plastic pallets are not suitable for unsupported or edge racking owing to insufficient strength and extreme deflection. Plastic pallets also become brittle in cold temperatures and subject to breakage.

Metal pallets have come into use to some degree over the past number of years but in the past the drawbacks of metal pallets have outweighed the benefits. Typical prior art metal pallets were heavy, costly, and mainly intended to be used as in-house pallets. Major problems encountered with prior art pallets include the possibility of weld breakage under heavy prolonged use with the result being that the component parts of the pallet work loose and may escape from the pallet altogether with unfortunate results. Additionally, many pallet designs pose a safety hazard owing to the fact that certain raw edges are exposed and can cause injury to personnel. Certain designs also failed to offer true four-way entry for both pallet jacks and forklifts, i.e. the pallets were not accessible from both sides and both ends.

Reference may be had to published International Application WO86/00866 which discloses a metal material handling pallet having a deck of corrugated planks and a spaced parallel base also of corrugated members both of which are welded to cross bearers. Each bearer comprises a pair of U-shaped channels welded back-to-back via their web portions. A suggested modification involves the use of closure plates which are welded across the ends of bearers, the closure plates having side flanges that are welded to the leg portions of the bearers and end caps which engage-over and are welded to the side channels of the deck and the base.

Reference may also be had to U.S. Pat. No. 2,152,086 which discloses a metal pallet having opposed parallel decks and comprising corrugated members with special profiles extending along both sides of the pallet and defining U-shaped flanges which engage and cover up the edges of the corrugated members.

SUMMARY OF THE INVENTION

It is a general object of the present invention to provide a pallet, particularly a metal pallet, which alleviates the several disadvantages of the prior art metal pallets discussed above.

Thus, in accordance with the invention there is provided a metal pallet including a pallet deck and support means fixed to the pallet deck to support it clear of a support surface on which the pallet is resting and to allow tines of a fork lift or the like to enter below the pallet deck, wherein said pallet has: parallel corrugated top members each having opposed end portions disposed along opposed sides of the pallet deck; a plurality of spaced, parallel, generally rigid cross members extending transversely of and lying below said top members, marginal side members extending and secured along the opposed sides of the pallet deck, each having a pair of generally parallel flanges extending lengthwise of the marginal side members and spaced apart to receive therebetween and to cover the respective end portions of respective top members such that each said end portion is secured between the flanges of a marginal side member, and wherein said pallet deck includes said top members and said cross members, which cross members are corrugated and fixed by securements to the underside of said top members with opposed end portions of the cross members disposed at opposed ends of the pallet deck, said top members including two marginal top members each extending along the entire length of a respective one of the opposed ends of the pallet deck and each having a downwardly extending marginal web terminating in longitudinal inturned flange means disposed immediately below corresponding end portions of the cross members, the inturned flange means of the marginal top members and the flanges of the marginal side members further securing together the top members and the cross members so as to assist in preventing their separation in the event of breakage of said securements.

In several embodiments of the invention each of the opposed ends of the marginal top members is connected to a respective one of the opposing ends of said marginal side members, the generally parallel flanges and the inturned flange means extending the full lengths of the marginal side members and the marginal top members respectively such that together they circumscribe the remaining top members to assist in providing a rigid, strong, pallet deck and in covering up any raw edges defined by said end portions of the top members and said cross members respectively.

In one preferred embodiment, the support means includes a multiplicity of spaced apart corrugated metal members of somewhat elongated generally U-shape configuration, each comprising an elongated central section, the opposing ends of which are joined to upright leg portions, with the upper ends of the latter being joined to the associated marginal side members. The dimensions of and spacing between the support members are selected so as to provide true four-way entry of forklifts and pallet jacks as noted previously.

The support system may also include a multiplicity of generally U or V-shaped struts extending between the midpoints of the central sections of the support means upwardly so as to bear against the underside of the pallet deck thereby to provide the desired degree of rigidity to the structure.

An alternative form of support for the pallet deck may be utilized when two-way entry only is required as is common for example in the brewing industry. In this situation the above-noted elongated U-shaped supports are not utilized but, rather, there are provided suitably shaped rigid supports which extend lengthwise of and downwardly from the opposed marginal sides of the pallet deck in spaced parallel relationship to one another. These elongated supports are shaped to engage upper portions of beer kegs to allow secure stacking of palletized kegs.

Another alternative may be described as a "reversing" pallet. This design employs two spaced parallel decks as described above secured together in back to back relation by way of rigid marginal web portions which are preferably integrally formed with the previously noted marginal side members. This double-decked reversible design offers significant advantages in numerous areas of use.

Another embodiment of the invention provides a "nestable" pallet construction. In this arrangement, the pallet deck structure is essentially as described above. However, portions of several of the corrugated top members are bent or deformed away from the plane of the deck defined by the top members generally to provide truncated V or U-shaped support legs to elevate the deck above the floor and allow easy handling, including entry of the tines of a fork-lift.

Another embodiment may be termed a horizontal keg pallet, so-named because of its ability to carry and allow stacking of horizontal keys. In this structure, opposed spaced apart decks are provided, secured by intermediate members extending between and welded to the opposing cross-members of the respective decks. The deck top members are arranged to provide a spaced parallel pair of wide gaps running side-to-side of the pallet decks to allow the horizontal kegs to nest within them. Further details will be provided later in this disclosure.

Preferred embodiments of the invention will now be described, reference being had to the appended drawings.

BRIEF DESCRIPTION OF THE VIEWS OF DRAWINGS

Figure 14:
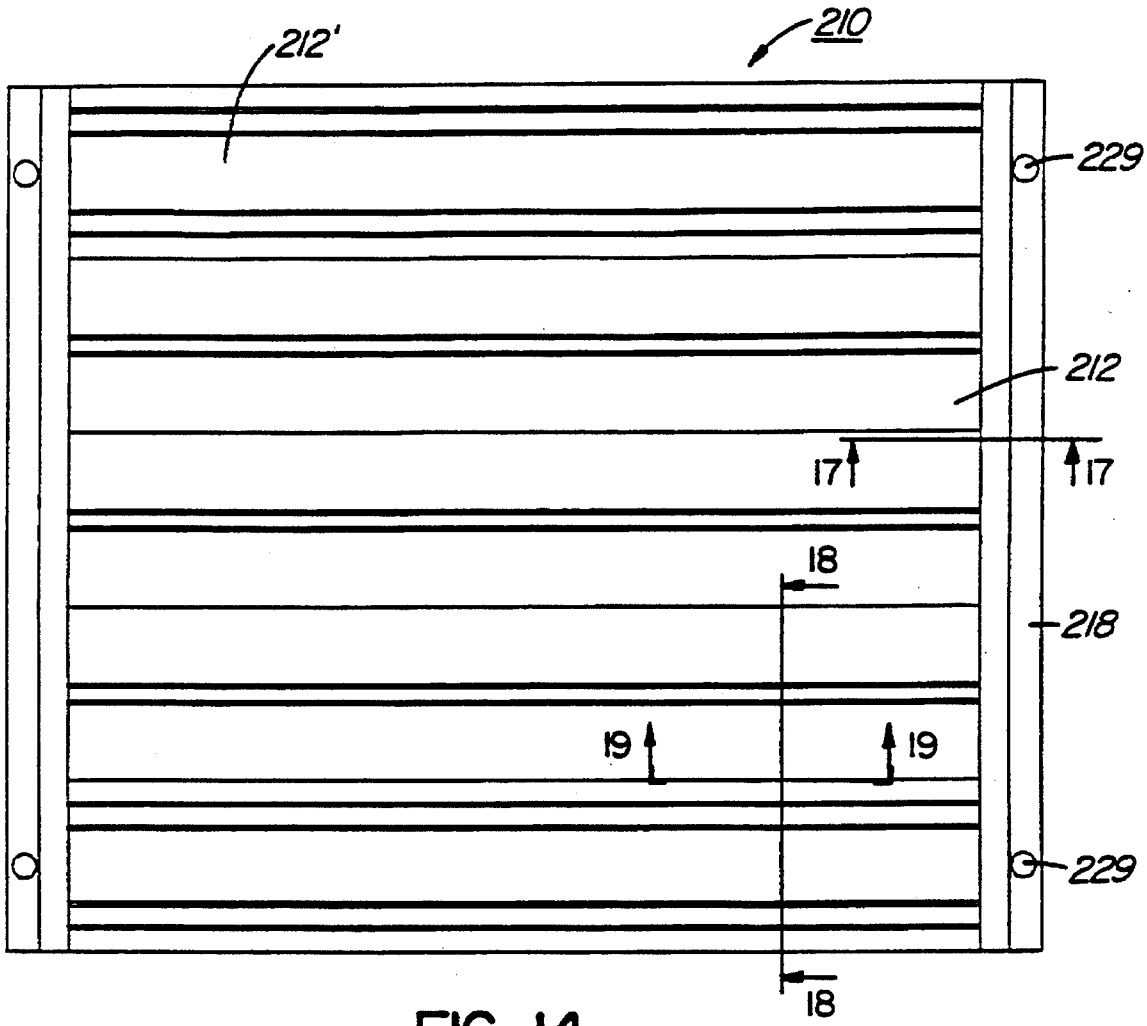
Figure 15:
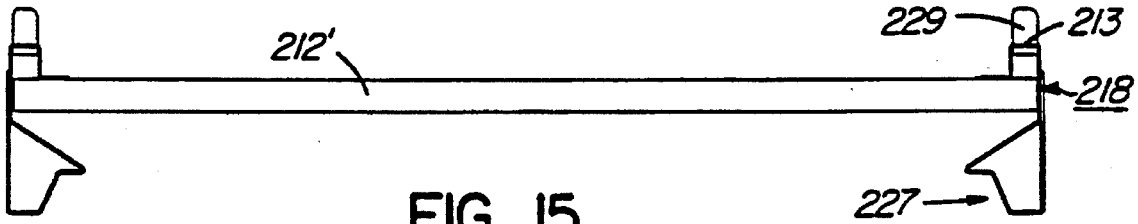
Figure 16:
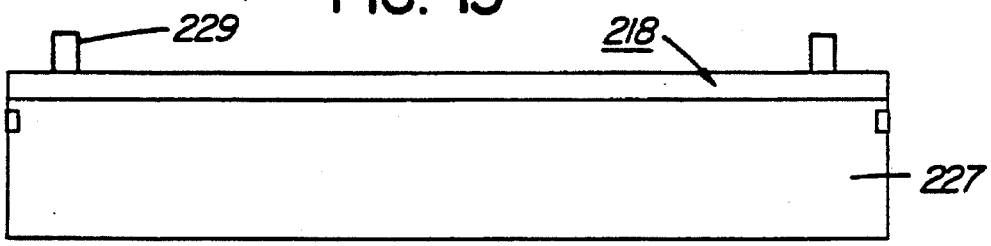
Figure 17:
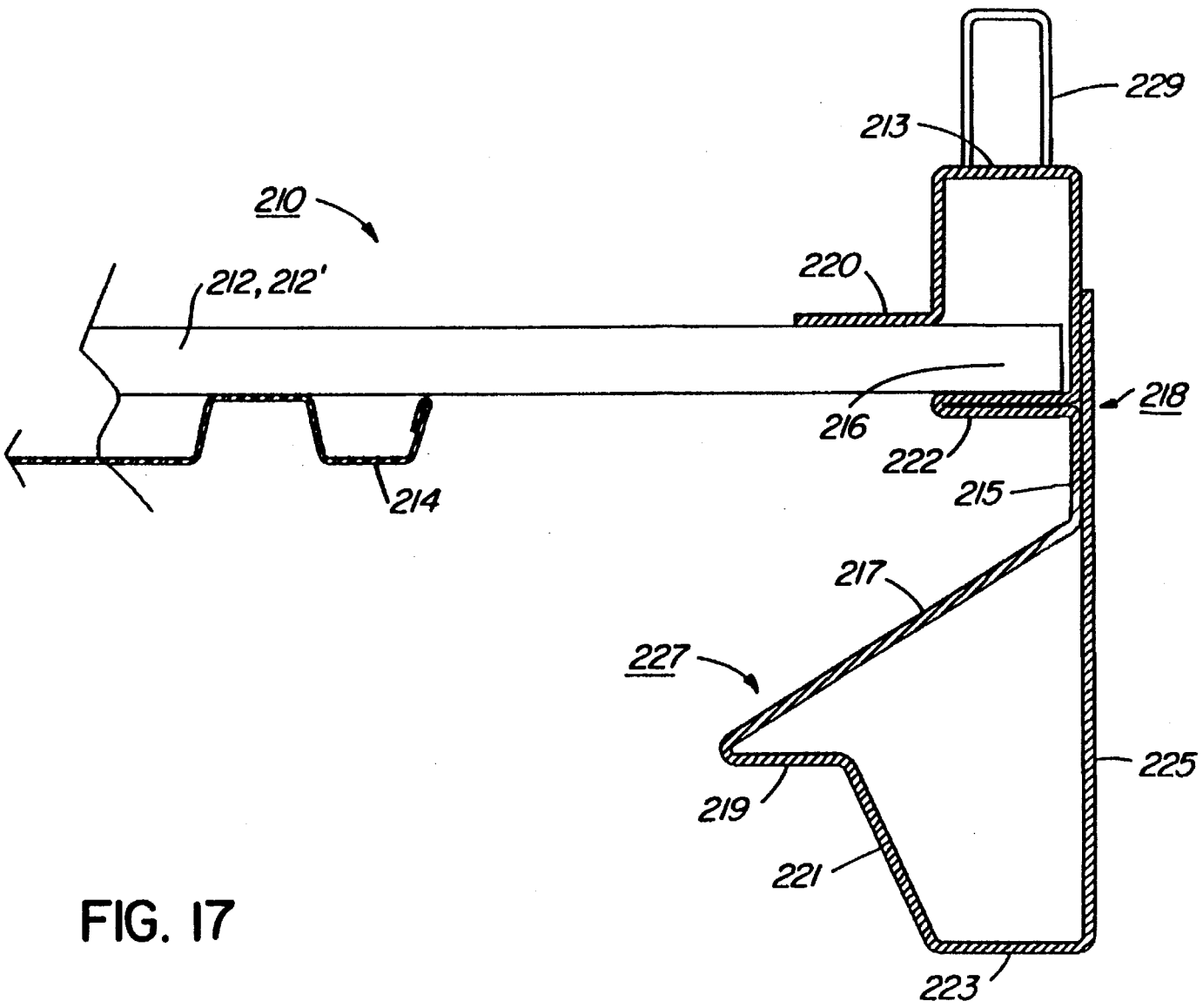
Figure 18:
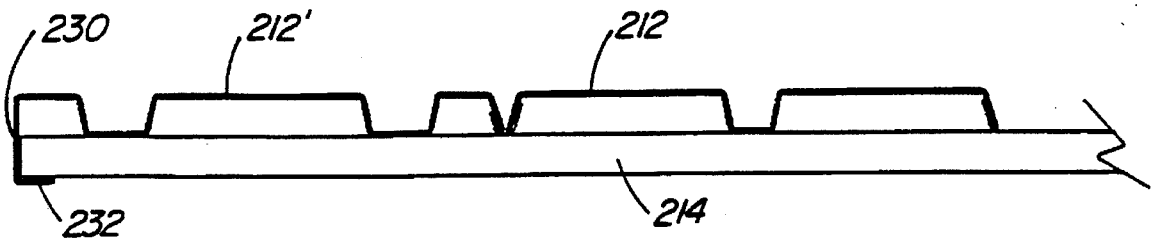
Figure 19:
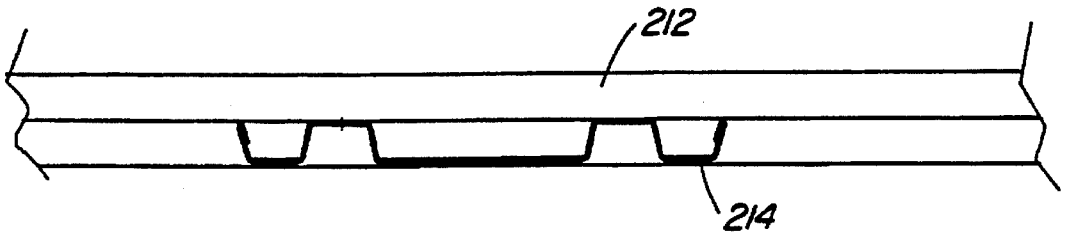
Figure 20:
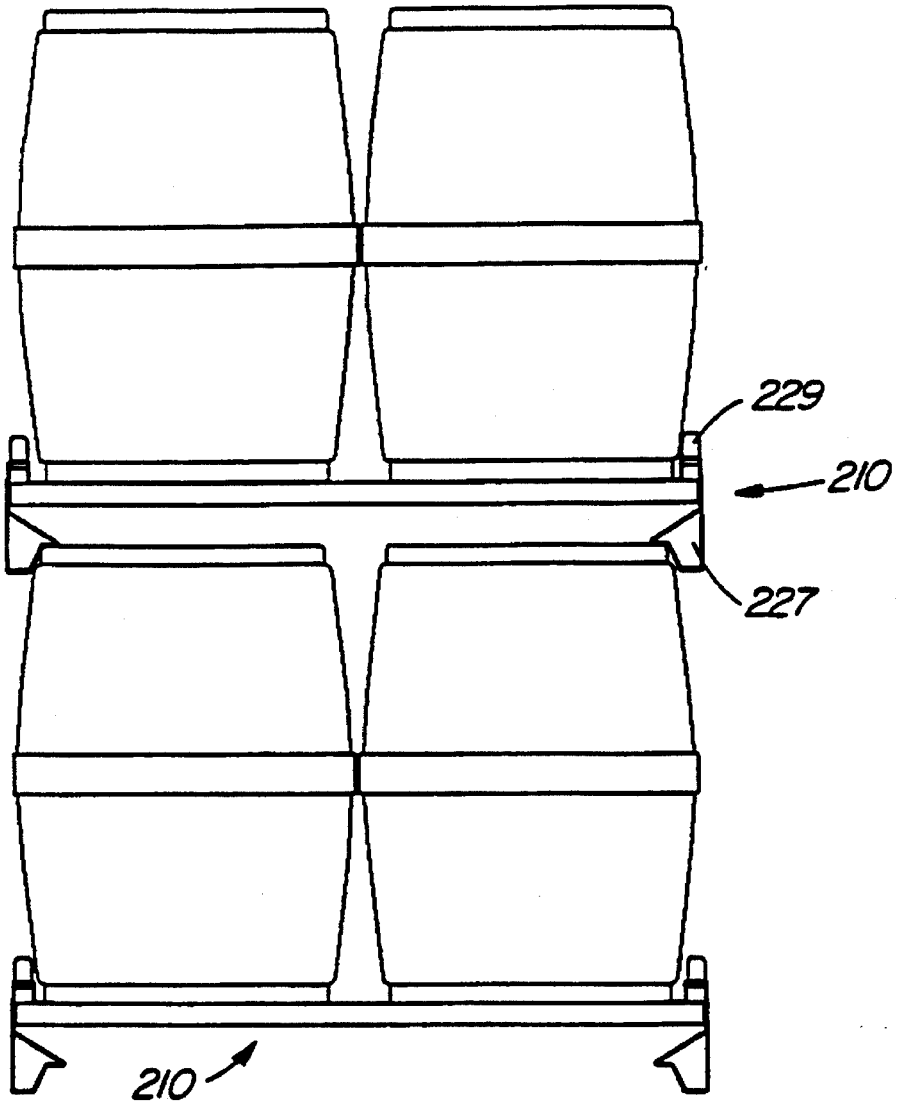
Figure 21:
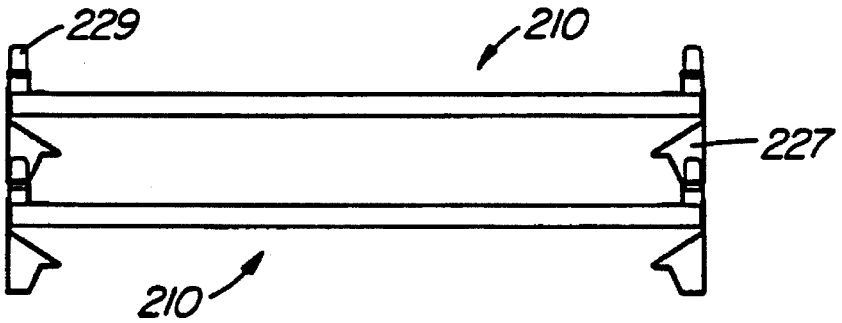
Figure 23:
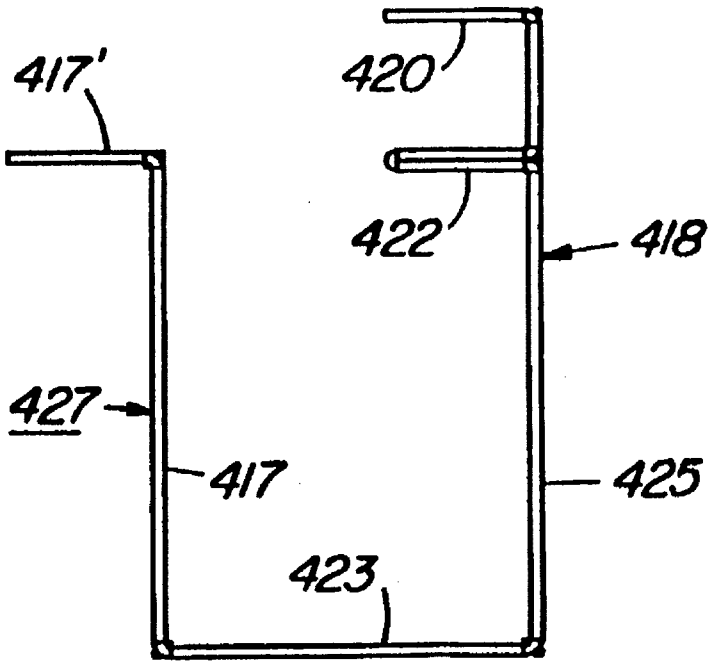
Figure 22:
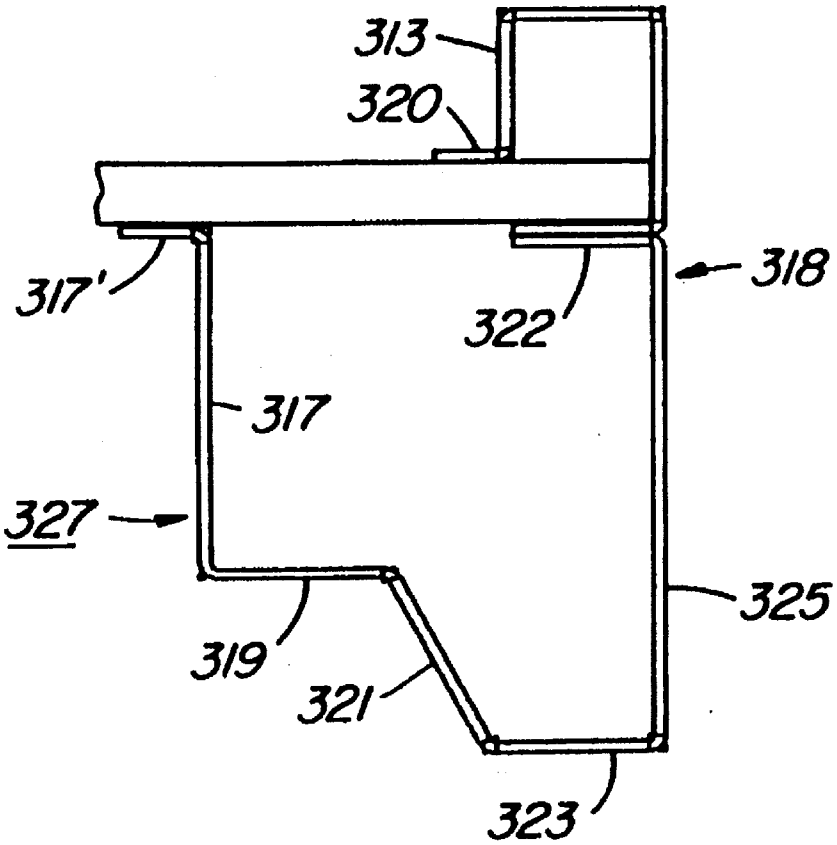

FIG. 14 a plan view of a modified pallet specially adapted for use in the brewing industry;

FIGS. 15 and 16 are end and side elevation views respectively of the pallet of FIG. 14;

FIGS. 17, 18 and 19 are partial section views along lines 17—17, 18—18 and 19—19 respectively of FIG. 14;

FIG. 20 is an end elevation view showing multiple tiers of palletized beer kegs, the pallets being in accordance with FIGS. 14–19;

FIG. 21 is an end elevation view showing pallets according to FIGS. 14–19 in stacked storage positions;

FIGS. 22 and 23 are end elevation views of further modified marginal side members.

Figure 24:
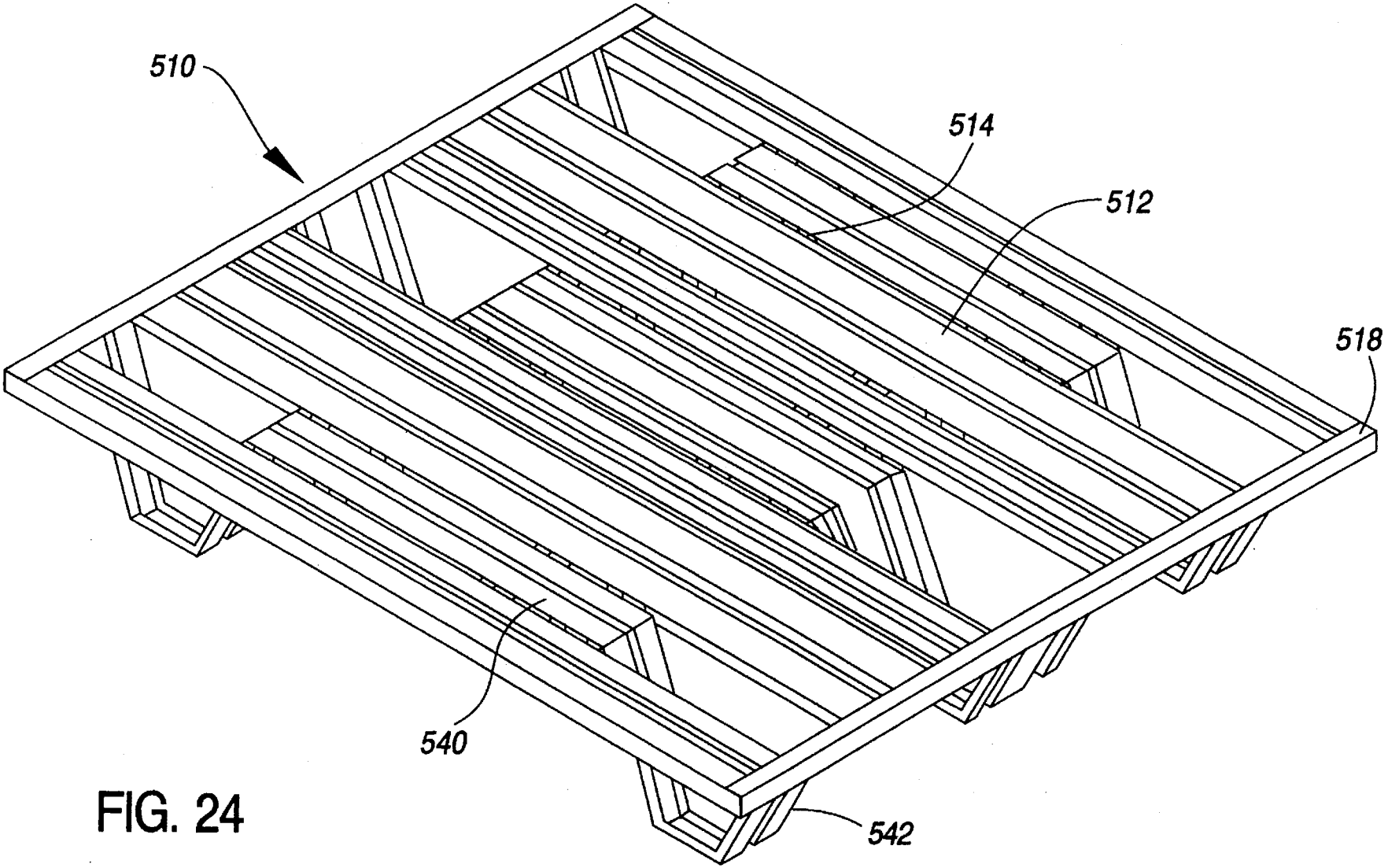
Figure 25:
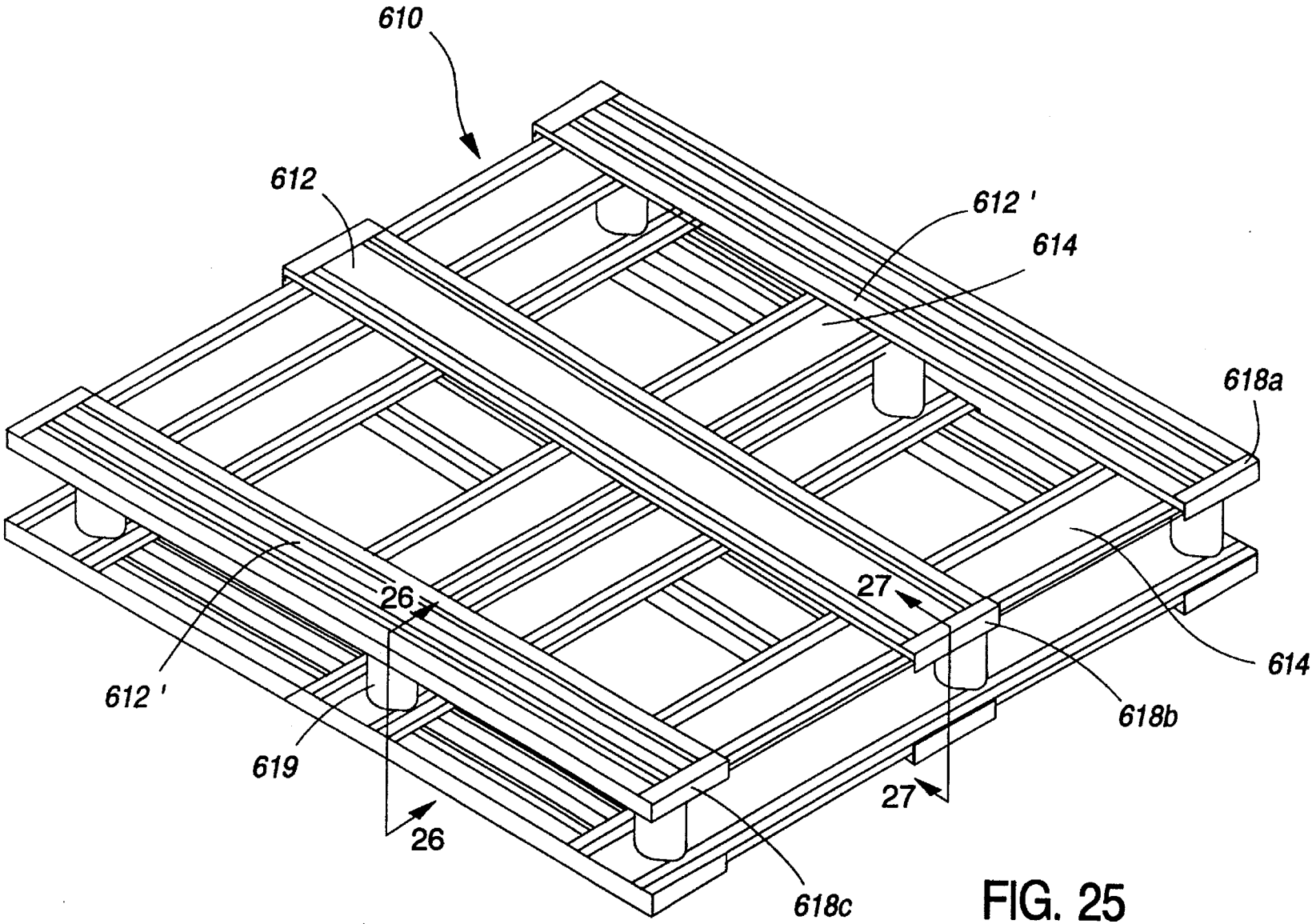
Figure 27:
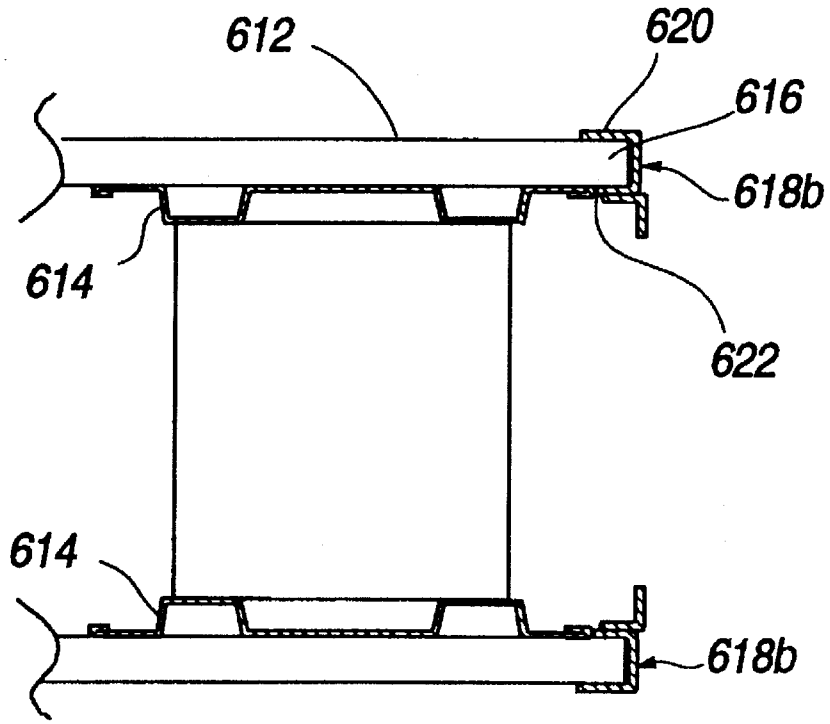
Figure 26:
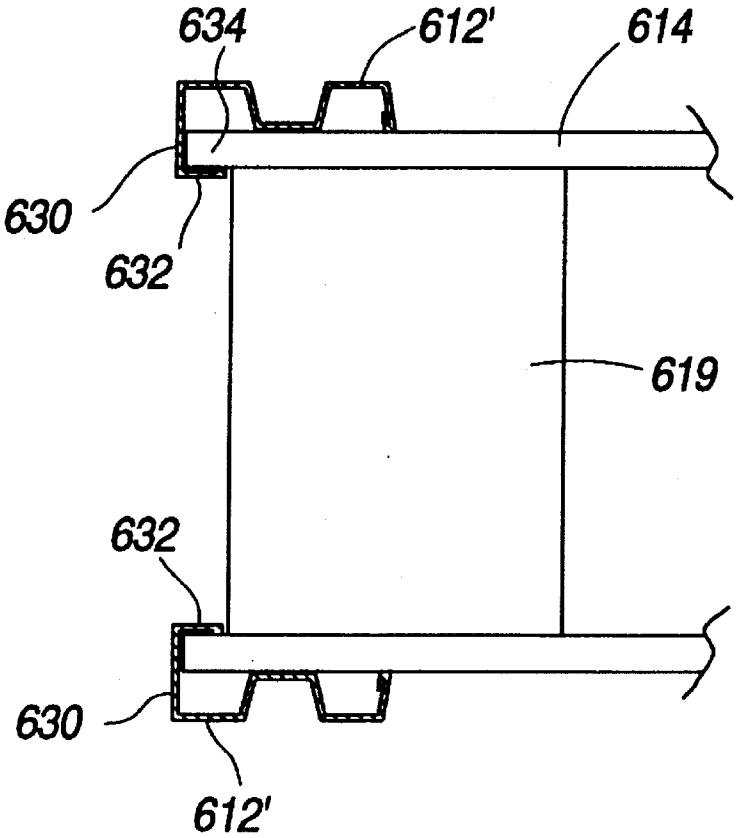

FIG. 24 is a perspective view of a modified pallet capable of being stored in "nested" relation with other pallets;

FIG. 25 is a perspective view of a further embodiment, namely, a horizontal keg pallet;

FIG. 26 is a cross-section view along line 26— 26 of FIG. 25;

FIG. 27 is a cross-section view along line 27— 27 of FIG. 25.

DETAILED DESCRIPTION OF THE PREFERRED EMBODIMENTS

Referring now to FIGS. 1–9 of the drawings there is shown a metal pallet 10 of welded construction made in accordance with the principles of the present invention. The pallet includes a multiplicity of parallel spaced apart corrugated top members 12 lying essentially in a single plane. A spaced parallel pair of corrugated cross-members 14 extends transversely of and lies below the plane of the top members 12. The cross-members 14 are firmly secured to the undersides of the top members by welds, to be further noted hereafter.

The top members 12 each have opposed end portions 16 with these end portions of the respective top members being disposed along the opposed sides of the pallet. The pallet is also provided with a pair of marginal side members 18, each of which extends along a respective one of the opposed sides of the pallet and, together with the previously noted top members 12 and cross-members 14 forming the deck of the pallet.

Figure 6:
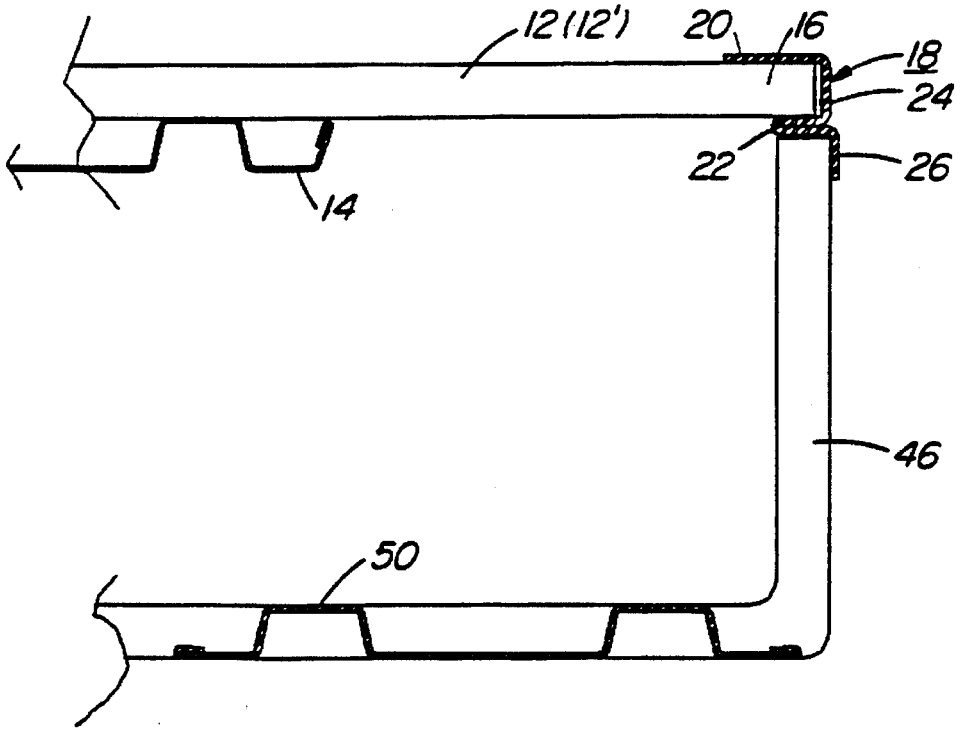
FIG. 6 is a partial section view taken along line 6—6 of FIG. 3.
Figure 7:
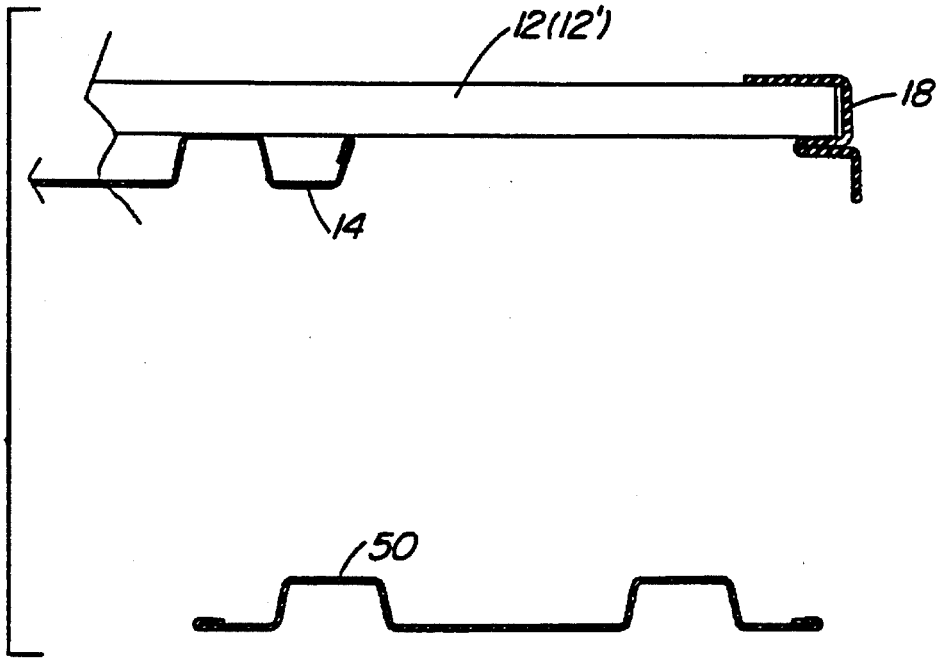
FIG. 7 is a partial sectional view taken along line 7—7 of FIG. 3.

As best seen in FIGS. 6 and 7, each marginal side member 18 is roll formed from relatively heavy gauge steel so as to provide a spaced apart pair of parallel flanges 20 and 22 extending longitudinally thereof. These spaced apart flanges are separated by an intermediate web portion 24 and lower lip portion 26 extends downwardly below the lowermost flange 22. The flanges 20 and 22 are spaced apart just sufficiently as to receive therebetween the end portions 16 of the respective top members 12. Suitable welds are provided so as to firmly secure the opposing ends of the top members to the marginal side members 18 between the upper and lower flanges 20, 22 thereof.

Figure 8:
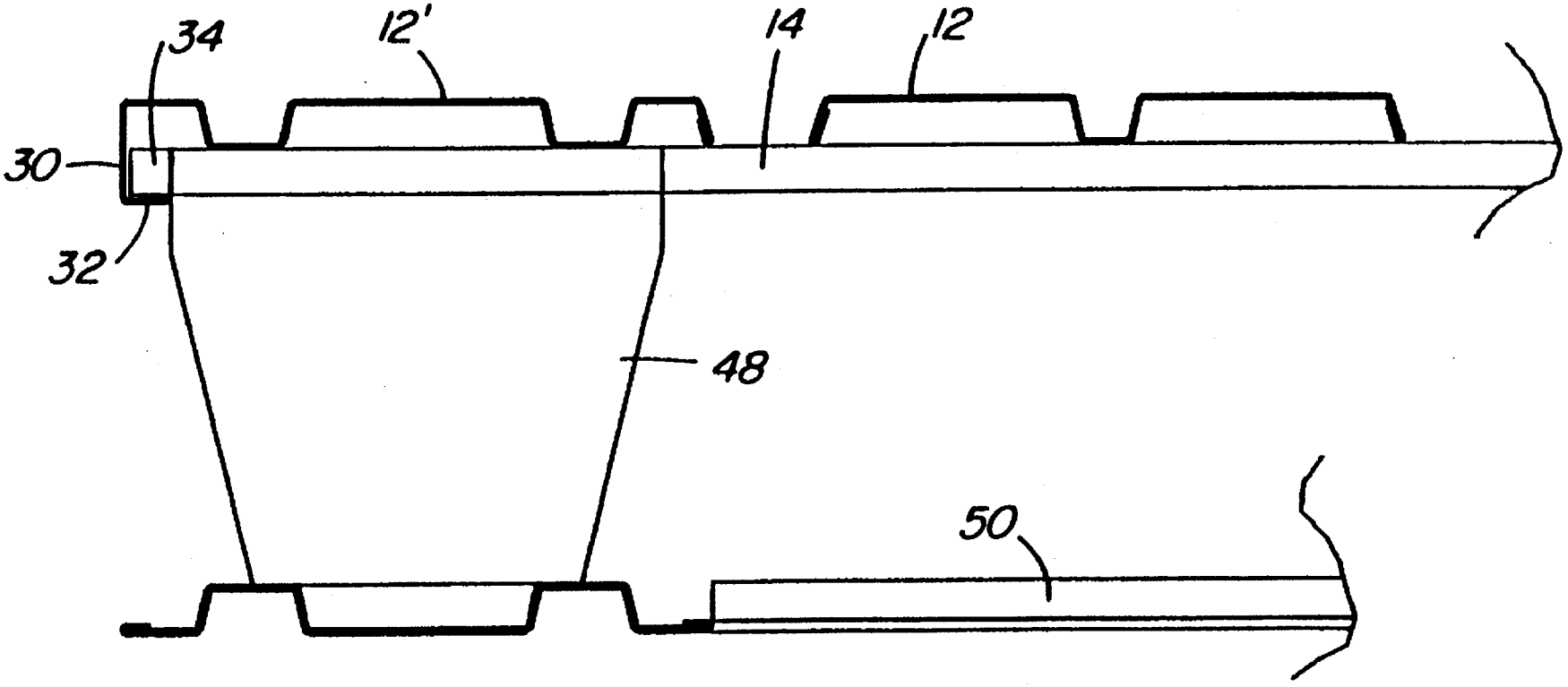
FIG. 8 is a partial sectional view taken along line 8—8 of FIG. 3.
Figure 9:
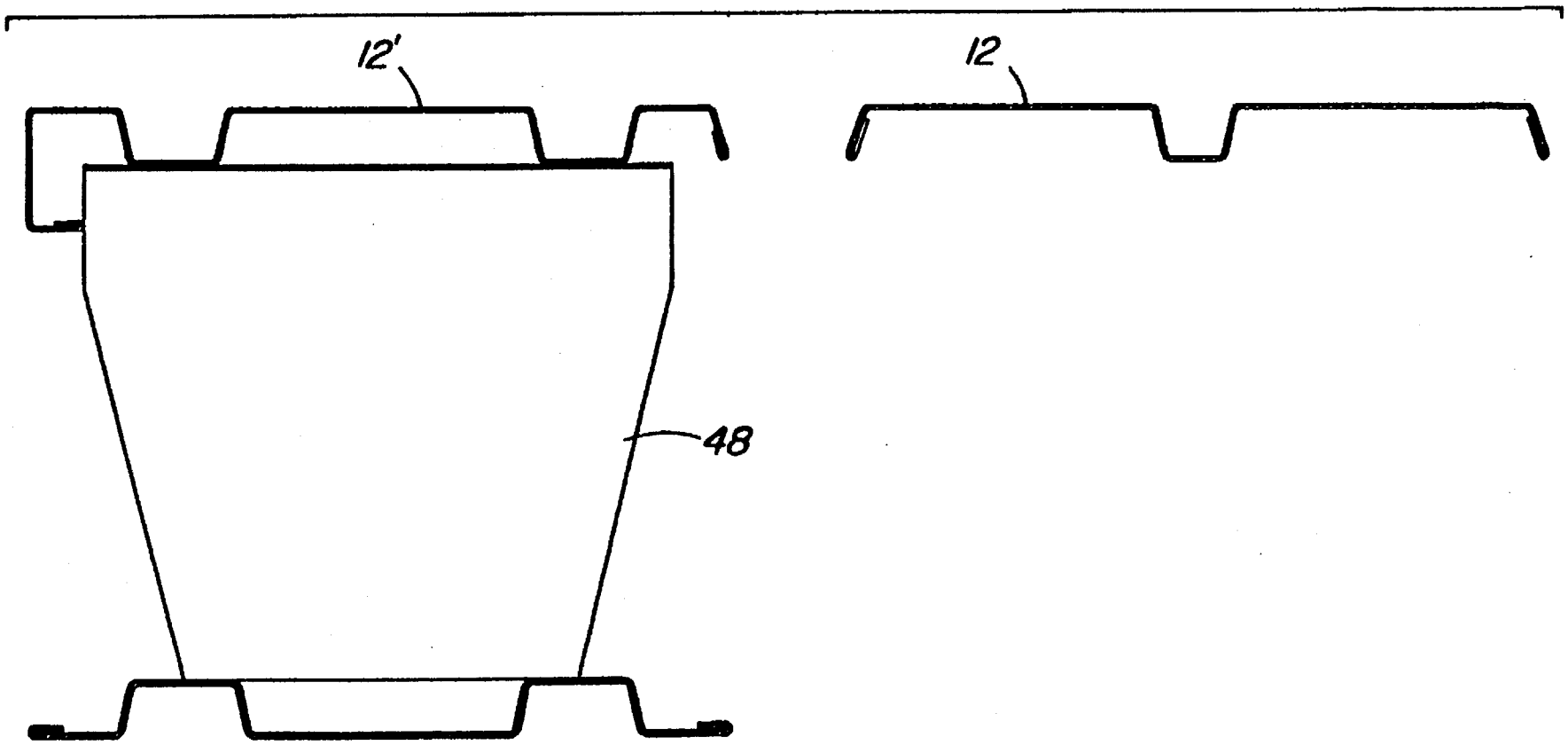
FIG. 9 is a partial sectional view taken along line 9—9 of FIG. 3.
Figure 10:
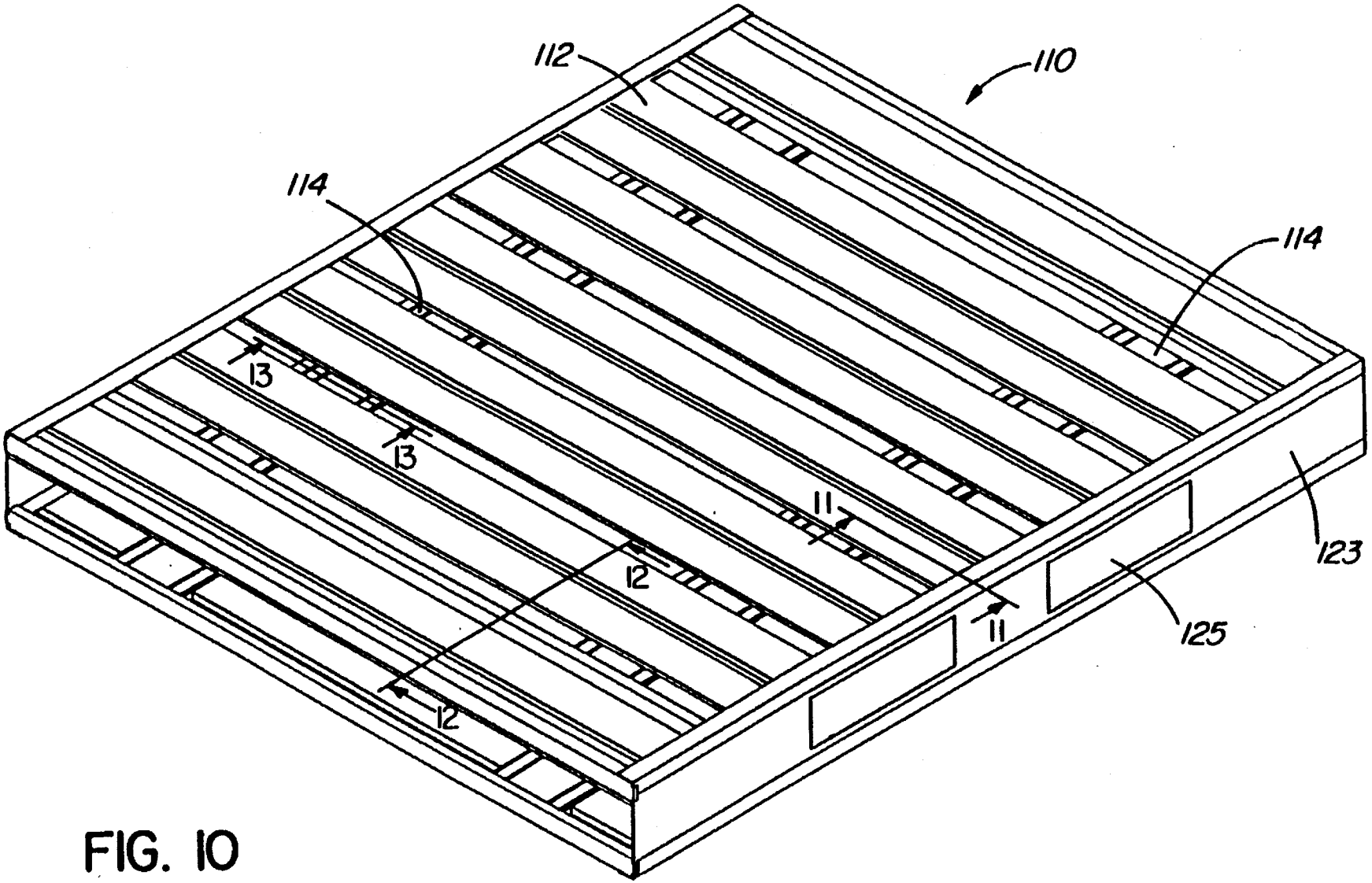
FIG. 10 is a perspective view of another embodiment, i.e. double decked reversible pallet.
Figure 11:
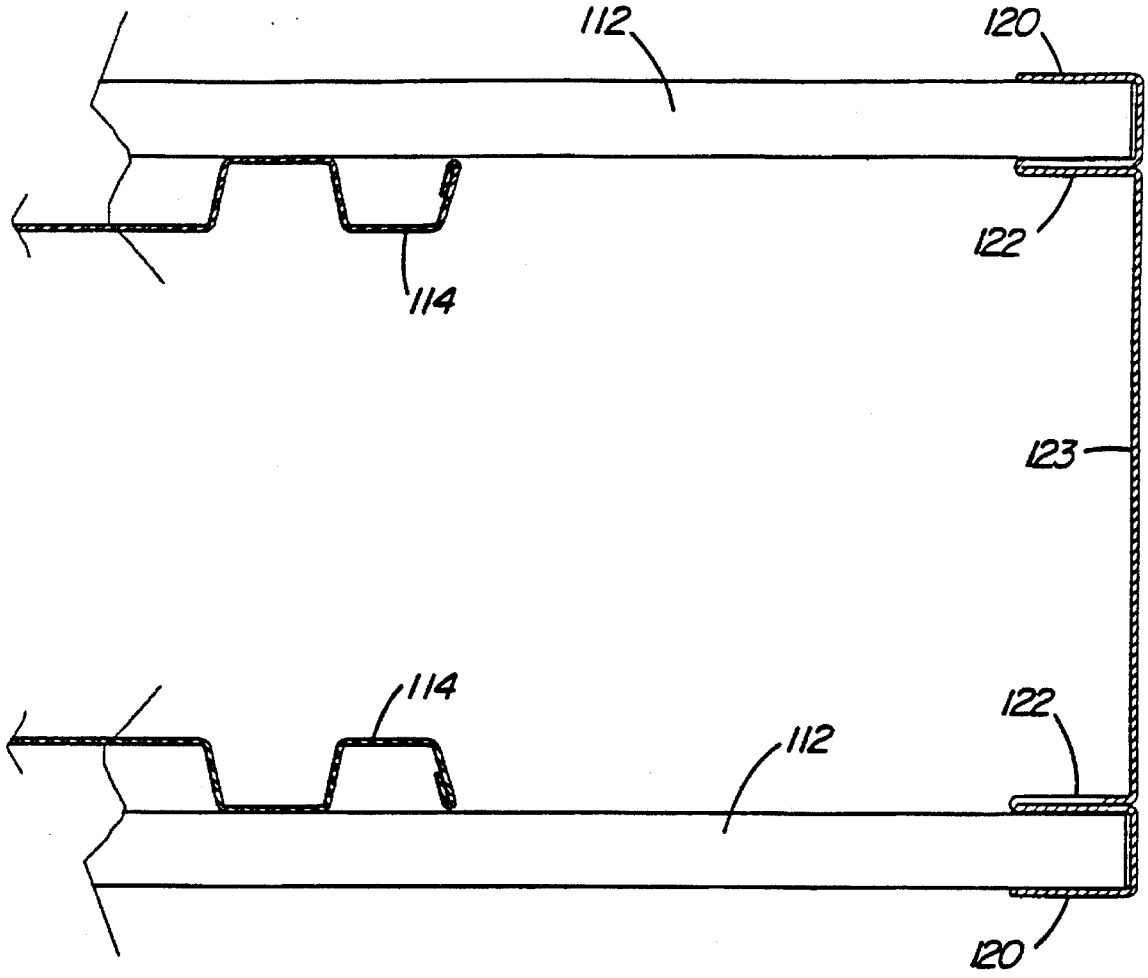
FIG. 11 is a section view along line 11—11 of FIG. 10.

The corrugated top members 12 intermediate the opposing ends of the pallet have the cross-sectional configuration as best illustrated in FIG. 8. However, it will be noted that the top members include a pair of marginal top members 12' each extending along a respective one of the opposed ends of the pallet. Each of these marginal top members 12' differs from the remaining top members 12 in that they are each provided, along the outer longitudinal edge thereof, with a downwardly extending web 30, at the lower end of which is disposed an inwardly turned flange 32. The web 30 and flange 32 are dimensioned such that when the marginal top members 12' are in their correct positions adjacent the opposing ends of the metal pallet, the inturned flanges are firmly engaged beneath opposing end portions 34 of the respective corrugated cross-members 14. This is all clearly illustrated in FIG. 8.

Each of the opposed ends 36 of the marginal top members 12 is firmly connected to a respective one of the opposed ends 38 of the marginal side members 18 such that together these members 12' and 18 circumscribe the remaining top members 12 and, by way of the above described flanges 20, 22 and 32 thereon, cooperate together to secure the top members 12 and the cross-members 14 together. This serves to assist in preventing their separation from the pallet deck in the event that any of the welds normally securing them together should break in the course of extended rough usage. Another important advantage provided by the aforementioned structures is that the raw edges defined by the opposing ends of the top members 12 and the cross-members 14 are effectively completely covered up thus reducing greatly the chances that personnel will be injured in the course of using the pallet.

As previously noted, the pallet 10 includes a support means joined to the pallet deck and extending downwardly therefrom to support the pallet deck clear of a support surface (floor or the like) on which the pallet is resting to allow a forklift or the like to enter below the pallet deck for transportation purposes.

The support structure 40 comprises a plurality, in this case three, of spaced apart corrugated metal supports 42, each being of an elongated or very stretched out U-shape configuration. Each support 42 includes an elongated central section 44 extending from side to side of the pallet with the opposing ends of the central section 42 each being integrally joined to an upright leg portion 46. The upper end portions of the upright leg portion 46 in turn are joined by suitable welds to the downwardly extending lips 26 forming part of the previously described marginal side members 18 (see FIG. 6).

The widths of the several support members 42 may be varied depending upon circumstances thereby to accommodate differing modes of use.

The support structure further includes a multiplicity of generally V or U-shaped struts 48 extending upwardly between the mid-points of the central sections 44 with the upper end portions of these struts 48 being welded to and bearing against the underside of the pallet deck. The struts 48 serve to support the deck against deflection when heavy loadings are applied thereto.

In order to further stabilize the several support members 42 there additionally are provided lengthwise extending corrugated metal sections 50 which span between the support members and are firmly welded thereto thereby to provide the necessary structural strength and rigidity.

The several components of the pallet structure as described above are typically made from sheet steel of a thickness selected to provide the desired degree of strength and rigidity while at the same time avoiding excessive weight. The metal components are roll formed to provide the desired shapes as illustrated and the metal surfaces are galvanized or otherwise coated with a suitable rust inhibiting material.

Figure 1:
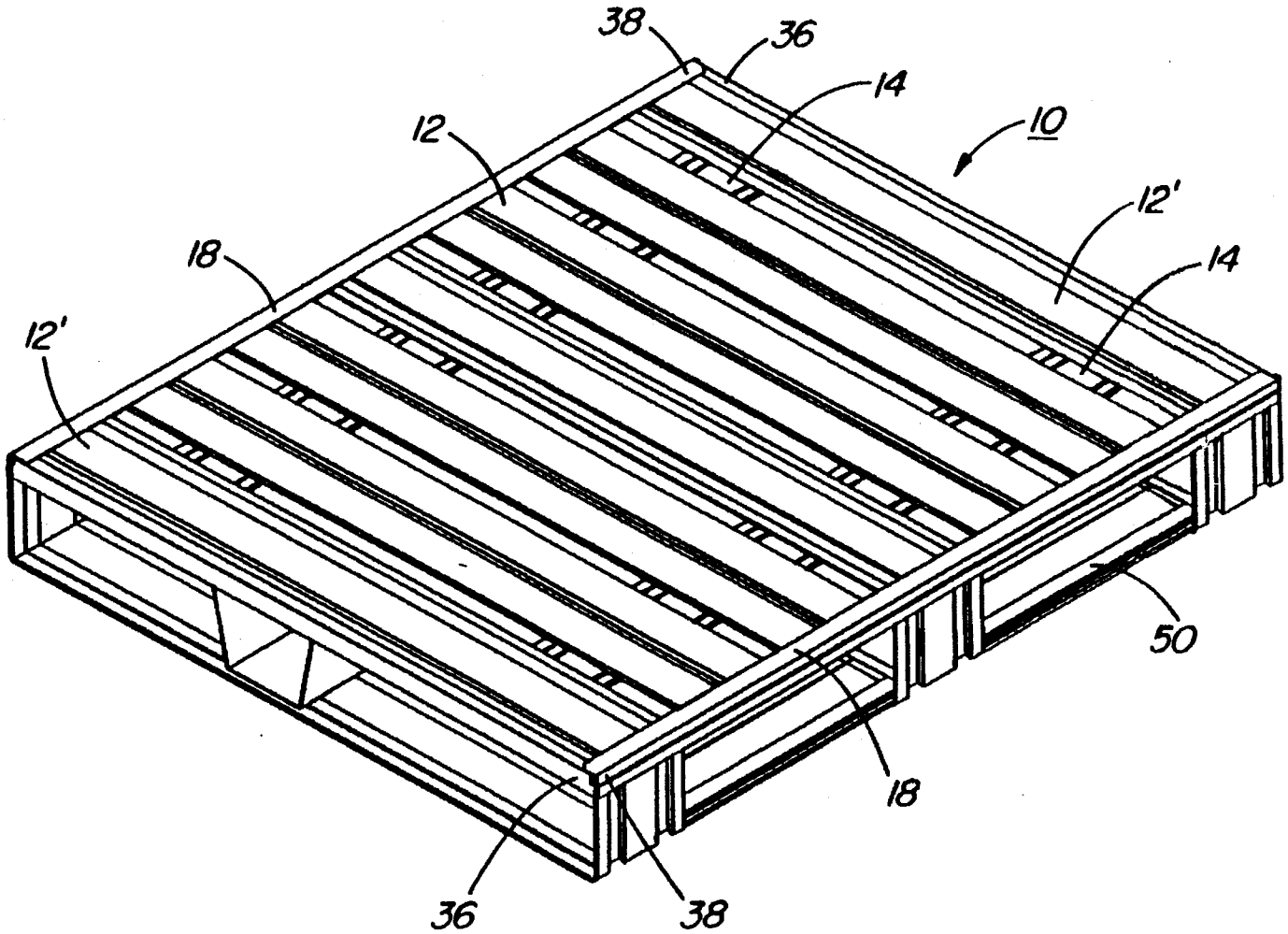
FIG. 1 is a perspective view of a metal pallet in accordance with the present invention.
Figure 2:
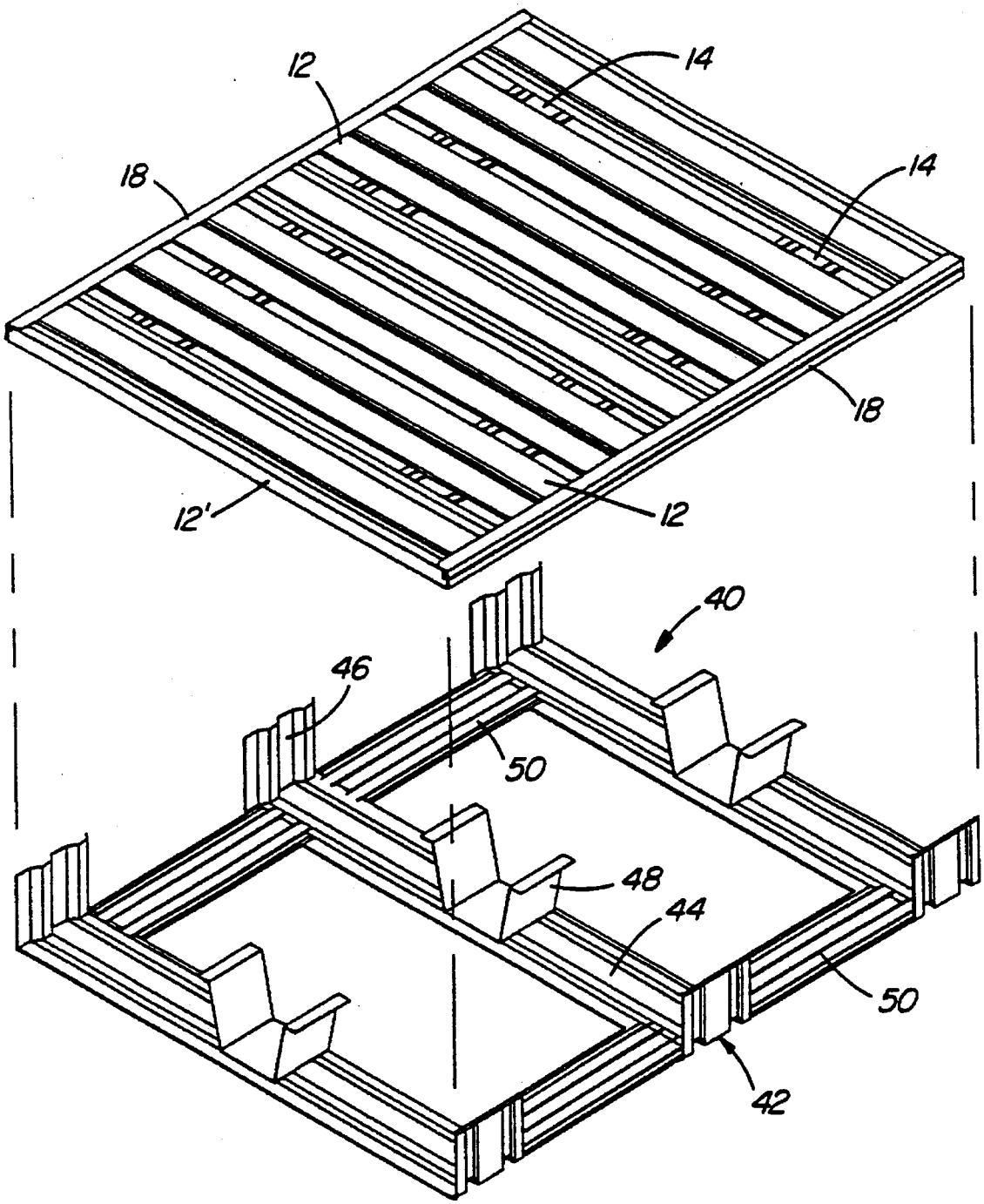
FIG. 2 is an exploded perspective view of the metal pallet showing the pallet deck raised above the support structure.
Figure 3:
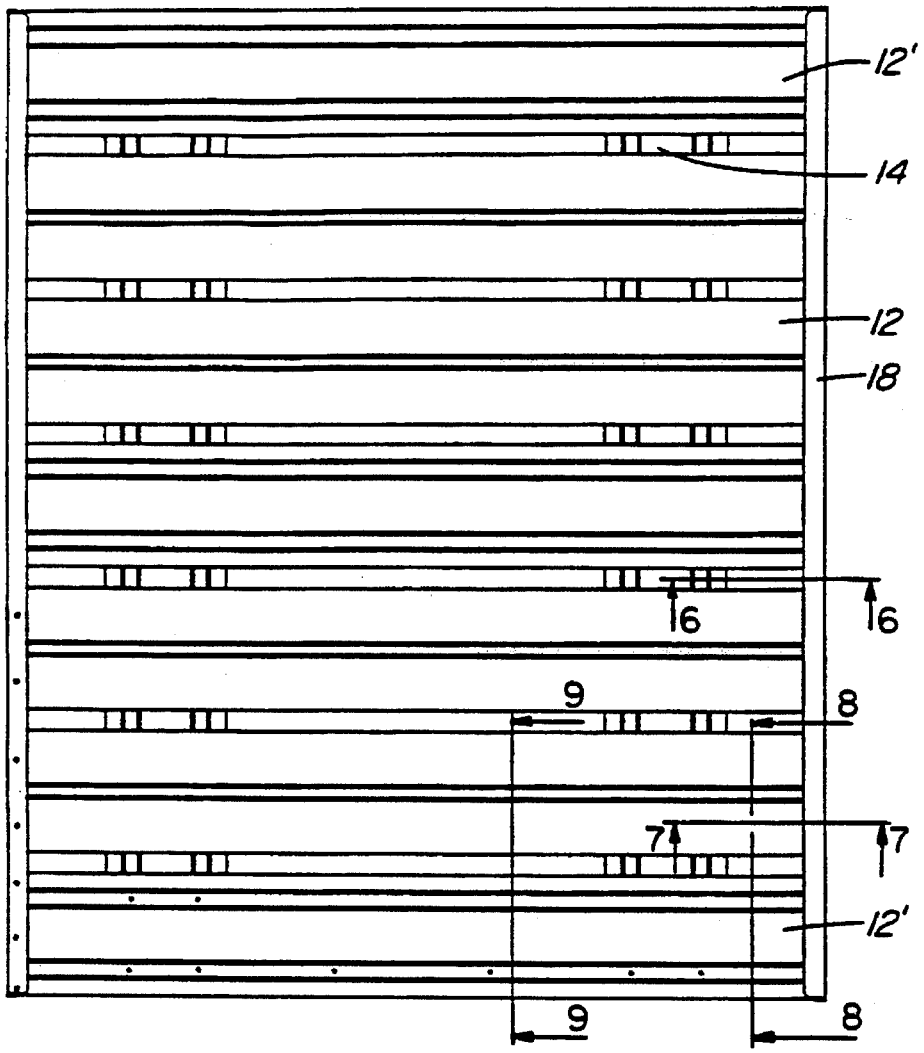
FIG. 3 is a top plan view of the metal pallet.
Figure 4:
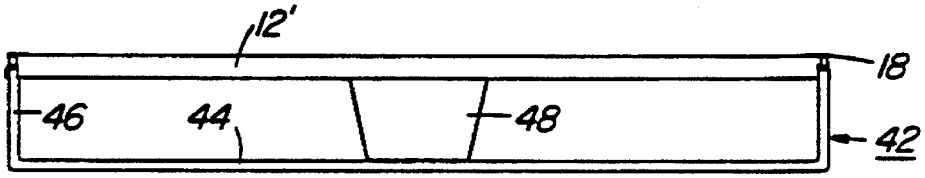
FIG. 4 is an end elevation view of the metal pallet.
Figure 5:
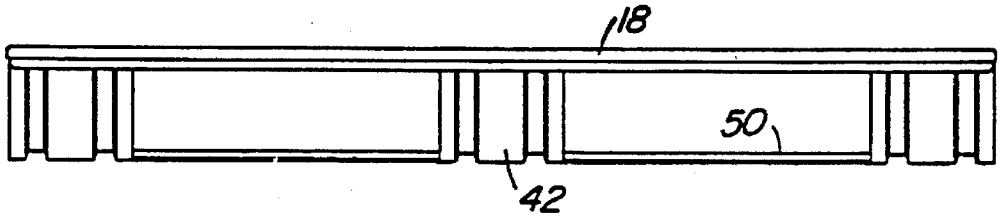
FIG. 5 is a side elevation view of the metal pallet.

The various components, e.g. the top members 12, cross-members 14, marginal side members 18 and all of the other remaining components are welded together using known techniques, such as spot welds. A number of these spot welds are illustrated in FIG. 3 toward the lower left corner (other welds being omitted for simplicity's sake). Obviously, any well known connecting techniques (including riveting) may be used as considered suitable by those skilled in the art under the circumstances.

Reference will now be had briefly to the double-decked reversible pallet embodiment of FIGS. 10– 13. Similar parts have been given the same reference numbers increased by 100.

The reversible pallet 110 has a pair of spaced parallel back to back decks, each having outwardly facing top members 112 and inwardly facing cross members 114 as described before. The marginal side members 118 vary from those described previously in that they each provide two pairs of spaced parallel flanges 120, 122 which receive therebetween and are welded to the opposing end portions 116 of the top members 112 of both decks. A rigid web 123 secures the two sets of flanges together and rigidly maintains the desired spacing between the decks. Optional elongated slots 125 permit side entry of fork lifts as desired.

Figure 12:
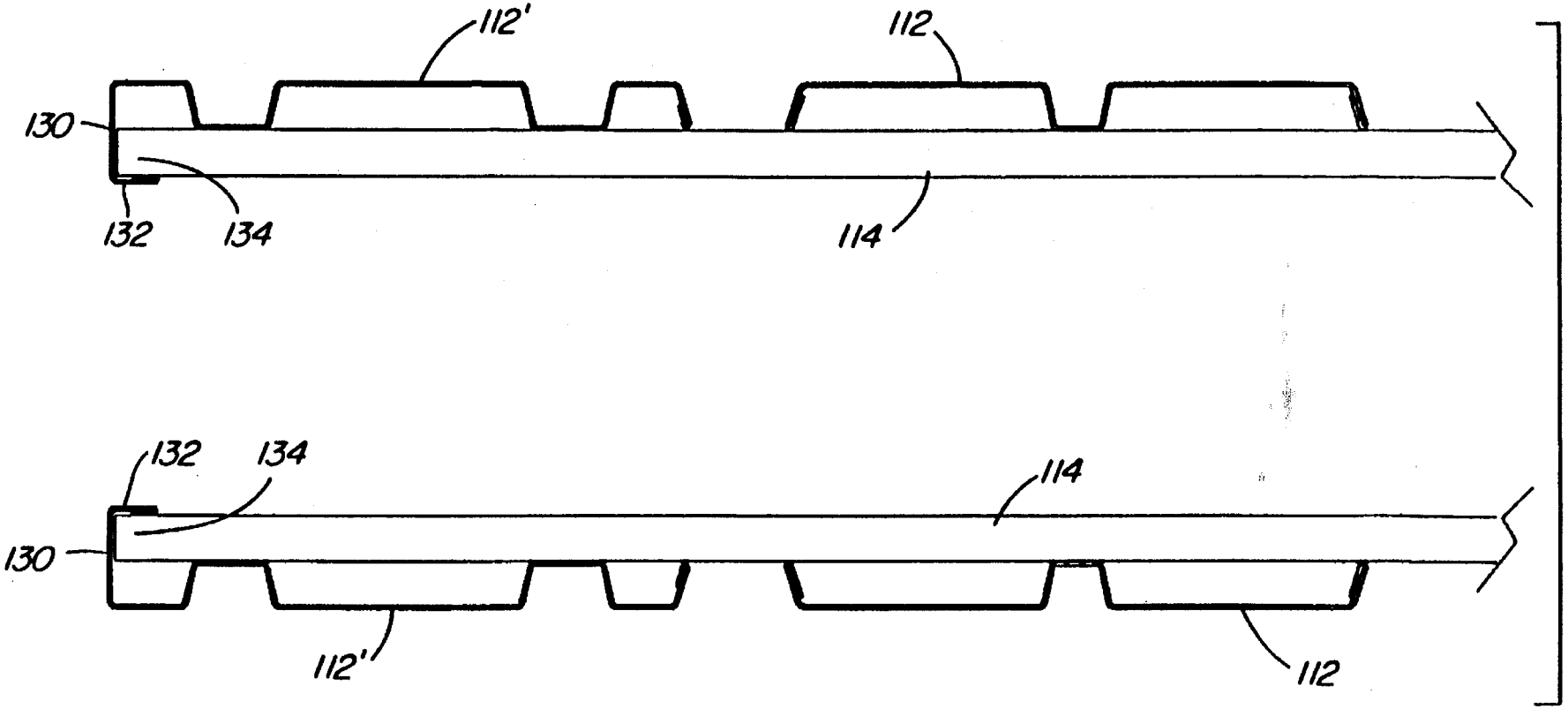
FIG. 12 is a section view along line 12—12 of FIG. 10.
Figure 13:
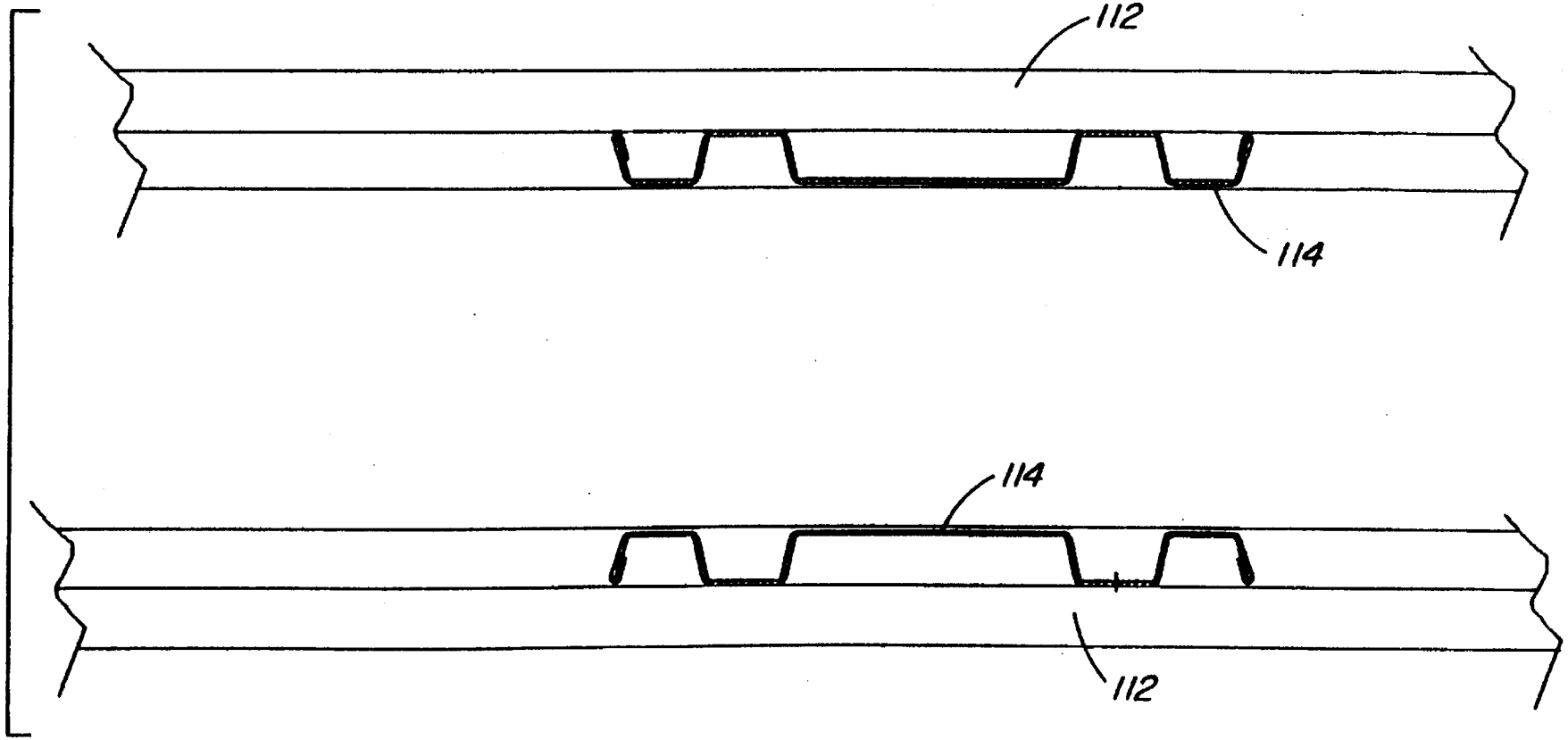
FIG. 13 is a section view along line 13—13 of FIG. 10.

As best seen in FIG. 12, the marginal top members 112' include flanges 130 and inturned flanges 132 which firmly engage the opposing end portions 134 of the respective cross members 114. Opposed ends of marginal top members 112' are welded to respective opposing ends of the marginal side members 118 thereby achieving the several benefits described with the first embodiment in terms of structural integrity, safety and the like.

With reference now to FIGS. 14–19, there is shown a modified pallet arrangement suitable for use in the brewing industry although its use is not thus limited. Parts similar to those of the FIG. 1–9 embodiment have been given the same reference number, increased by 200.

Thus, the pallet 210 includes parallel corrugated deck top members 212, 212' lying in a single plane and welded to a spaced pair of corrugated cross members 214 as described previously. The top members 212 and cross members 214 are locked firmly together via the previously described action of the circumscribing marginal top members 212' and their flanges 232 together with the marginal side members 218 and their flanges 220 and 222.

Only the modifications and attachments to marginal side members 218 need be described further. Again, these members 218 are of roll formed heavy gauge sheet steel. Starting with upper flange 220 which lies flat on and is fixed by welds to the end portions 216 of the top members 212, 212', there is provided an inverted U-shaped top channel portion 213 which rises above the top surface of the pallet deck. The outer wall of channel 213 extends downwardly across the ends of the top members and the metal sheet then is folded to form the lower flange 222 which underlies and is secured to the undersides of the above-noted end portions 216. The metal sheet then extends downwardly a short distance as at 215, thence sloping downwardly and inwardly as at 217 at about a 45° angle to the deck, thence turning horizontally outwardly a short distance parallel to the pallet deck at 219 and thence downwardly and outwardly as at 221 at approximately 60° to the pallet deck until the foot or base portion 223 is reached, which portion is parallel to the pallet deck. The metal sheet thence turns upwardly at right angles to the pallet deck and proceeds upwardly at 225 to join and be affixed by welds to portion 215 and the outer wall of the top channel 213, thus forming box-beam like supports 227 fixed to and effectively forming part of the marginal side members 218 and extending the full lengths of the opposing sides of the pallet 210.

A modified marginal side member 318 is shown in FIG. 22 (parts similar to those described with reference to FIG. 17 having the same reference numbers, increased by 100). As will be readily seen, the only difference is that metal sheet portion 317, instead of being angled outwardly, extends at right angles to the deck and has a lip portion 317' which is welded to the underside of the deck. This affords greater strength and stability to the supports 327 as a whole and makes the pallet more suitable for heavier loading application.

The opposing supports 227,327 are useful in that they are shaped to engage to engage upper portions of standard beer kegs when multiple tiers of palletized kegs are stacked upon one another as shown in FIG. 20 while at the same time permitting end entry of a fork lift. Furthermore, the top channels 213 assist in providing stable stacking in that they help to ensure that the kegs are fully positioned on the pallet deck. Other advantageous features of these elements 213 and 227 will be readily apparent to those skilled in this art.

A still further modification of the marginal side members is shown in FIG. 23 designated 418, parts similar to those of the FIG. 22 embodiment having the same reference characters increased by 100. This particular profile is useful for a plain deck-type pallet for general purpose use where two-way entry of fork lifts and pallet jacks is acceptable. The configuration will be readily understood by those skilled in this art from a reading of the previous descriptions so a further discussion of this particular configuration is considered unnecessary.

Also as shown in FIGS. 14–17 and 21 and 22, the channels 213 are each provided with a spaced pair of steel pegs 229 firmly welded thereto. Pegs 229 are adapted to mate with and enter into corresponding apertures (not shown) in base portions 223 of the supports 227 when the pallets 210 are being stored in a stacked array, reference being had to FIG. 21. This assures the stability of the stack, avoiding safety hazards etc.

Referring to FIG. 24 there is shown a "nestable" pallet modification indicated 510. A number of these pallets can be stacked together in nested array thus taking up minimal storage space. The pallet deck structure is essentially as described previously with corrugated top members 512, cross-members 514, marginal side members 518 etc. The only difference is that three of the top members (shown as 540) are bent or deformed to provide truncated V-shaped legs 542 which extend below the plane defined by the top and cross members. These legs 542 support the pallet deck above floor level to facilitate use and entry of fork lift tines etc.

With reference to FIGS. 25–27 there is shown a horizontal keg pallet 610 for carrying and stacking of horizontally disposed kegs. The structure provides double-opposed decks each defined by corrugated top members 612, 612', corrugated cross-members 614, and marginal side members 618*a, b* and *c* all provided with spaced flanges 620, 622 which embrace the end portions 616 of the top members 612, 612'. The marginal top members 612' are provided with webs 630 and the inturned flanges 632 which engage and conceal the opposed ends 634 of the cross-members 614 as previously described. The marginal top members 612' are well spaced from the central top member 612 to provide spaced parallel wide gaps running side-to-side of the pallet to allow horizontal kegs to nest within them and to allow several pallets with nested kegs to be stacked.

The double-opposed decks of the pallet are secured together in spaced apart parallel relation by a series of short cylindrical tubes 619. These tubes are welded between opposed facing cross-members 614 of the respective pallet decks.

Although reference herein has been had to "welded" constructions, it will be appreciated that other forms of securements may be used, (such as rivets and certain structural adhesives) depending on the strength required for the particular application at hand.

While preferred embodiments of the invention have been described by way of example, those skilled in this art will readily appreciate that various changes and modifications may be made to the structures disclosed without departing from the spirit and scope of the invention. For definitions of the invention, reference is to be had to the appended claims.

We claim:

1. A metal pallet including a pallet deck and a support fixed to the pallet deck to support it clear of a support surface on which the pallet is resting and to allow tines of a fork lift or the like to enter below the pallet deck, wherein said pallet has parallel corrugated top members each having opposed end portions disposed along opposed sides of the pallet deck, a plurality of spaced, parallel, generally rigid cross members extending transversely of and lying below said top members, marginal side members extending and secured along the opposed sides of the pallet deck, each having a pair of generally parallel flanges extending lengthwise of the marginal side members and spaced apart to receive therebetween and to cover the respective end portions of said top members such that each said end portion is secured between the flanges of a marginal side member, and wherein said pallet deck includes said top members and said cross members, which cross members are corrugated and fixed by securements to the undersides of said top members, with opposed end portions of the cross members disposed at opposed ends of the pallet deck, said top members including two marginal top members each extending along the entire length of a respective one of the opposed ends of the pallet deck and each having a downwardly extending marginal web terminating in a longitudinal inturned flange disposed immediately below corresponding end portions of the cross members, the inturned flanges of the marginal top members and the parallel flanges of the marginal side members further securing together the top members and the cross members so as to assist in preventing their separation in the event of breakage of said securements.

2. The metal pallet of claim 1, wherein there are two marginal side members, each extending the full length of a respective side of the pallet and being connected at opposite ends to respective ends of the marginal top members, in that the flanges of the marginal side members and the inturned flanges of the marginal top members extend the full lengths of said members so as to engage the end portions of all the top members and end portions of all the cross members respectively so as to assist in providing a rigid, strong, pallet deck and in covering up any raw edges defined by said end portions of said top members and said cross members respectively.

3. The metal pallet of claim 1 wherein said support comprises a plurality of generally U-shape corrugated members spaced apart longitudinally of the pallet and each including an elongate central section extending from one side of the pallet to the other and two leg portions extending upwardly from the opposing ends of the central section adjoined by their upper end portions to the associated marginal side members.

4. The metal pallet of claim 3 wherein said support further includes a plurality of generally V or U-shaped struts extending between the pallet deck and said central sections of the generally U-shape corrugated members.

5. A metal pallet according to claim 1 wherein the support includes a further pallet deck having the same construction as the pallet deck recited in claim 1, the pallet deck and the further pallet deck being disposed in back-to-back, spaced, parallel relation and the support further including structure securing said pallet decks in said spaced parallel relation.

6. The metal pallet of claim 5, wherein the marginal side members of the two pallet decks are formed integrally with and interconnected by a rigid web constituting the further structure for securing said pallet decks together.

7. A metal pallet in accordance with claim 1 for use in the brewing industry to allow stacking of palletised beer kegs characterized in that said pallet has a top channel extending along each of the opposing sides of the pallet deck and extending above the deck, wherein the support includes a pair of supports extending below the pallet deck and along the opposing sides thereof, said supports being shaped to engage upper portions of beer kegs to permit multiple tiers of palletised kegs to be stacked one upon the other while permitting end entry of a fork lift below the pallet deck.

8. The metal pallet of claim 7 having pegs on said top channels and apertures in lower extremities of said supports, said pegs mating with said apertures to provide for stable stacking and storage of the pallets one upon the other.

9. The metal pallet of claim 1 wherein said pallet has a nestable configuration and includes a plurality of additional top members which are bent to provide said support in the form of spaced truncated V-shaped legs which extend downwardly below the pallet deck to support the latter above floor level to allow entry of fork lift tines below the deck and to permit a plurality of said pallets to be stacked together in a nested array when empty thus taking up minimal storage space.

10. The metal pallet of claim 1 being in the form of a horizontal keg pallet wherein the support comprises a further pallet deck having the same construction as the pallet deck recited in claim 1 with the two decks being in back-to-back spaced relation, each deck having marginal top members spaced from a central top member to provide spaced parallel gaps running side-to-side of the pallet to allow horizontal kegs to nest within them and to allow several pallets with nested kegs to be stacked.

11. The metal pallet of claim 1 being of steel construction with said securements comprising welds.

* * * * *